United States Patent [19]

de Almagro

[11] 4,311,101

[45] Jan. 19, 1982

[54] TABLE ATTACHMENT

[75] Inventor: Ignacia de Almagro, Miami, Fla.

[73] Assignee: Almagro Trading Company, Coral Gables, Fla.

[21] Appl. No.: 90,411

[22] Filed: Nov. 1, 1979

Related U.S. Application Data

[63] Continuation-in-part of Ser. No. 3,404, Jan. 15, 1979.

[51] Int. Cl.[3] ..... A47B 57/00; A47B 83/04

[52] U.S. Cl. ..... 108/152; 248/242; 248/246; 108/108

[58] Field of Search ..... 108/152, 108, 97, 26, 108/25, 92, 101; 248/242, 246, 219.1, 218.4, 241, 225.1

[56] References Cited

U.S. PATENT DOCUMENTS

| | | | |
|---|---|---|---|
| 1,271,557 | 7/1918 | Forsyth | 248/246 |
| 1,702,937 | 2/1929 | Friedemann | 248/242 |
| 1,789,815 | 1/1931 | Hanley | 108/152 X |
| 1,941,838 | 1/1934 | Hyams | 108/108 |
| 2,911,108 | 11/1959 | Nield | 108/152 |
| 3,234,897 | 2/1966 | Berk | 108/152 |
| 3,393,888 | 7/1968 | Henningsgard | 248/246 |
| 3,580,191 | 5/1971 | McDonnell | 108/152 |
| 3,680,235 | 8/1972 | Leemhuis | 108/152 |
| 3,776,498 | 12/1973 | Peters et al. | 248/219.1 |
| 3,875,873 | 4/1975 | Howitt | 108/25 |

*Primary Examiner*—Francis K. Zugel

*Attorney, Agent, or Firm*—John Cyril Malloy

[57] ABSTRACT

An improved table attachment for removably mounting and rotatably mounting an attachment on a conventional table having either vertical or non-vertical legs. The improved table attachment includes a base having a top surface and a bottom surface, a support member is attached to the bottom surface of the base approximately across the centerline of the base. The support member includes a front and rear side wherein the support member defines a top elongate longitudinal threaded hole having an opening in the front side and a bottom longitudinal hole lower than the first hole and approximately parallel to it having an opening in the front side and extending through to the rear side of the support member. Structure for connecting the portable table attachment to a conventional table leg engage the top and bottom longitudinal holes and the table leg in such a manner that the table attachment is supported by the table leg and the attachment is able to rotate a limited distance laterally. Multiple table attachments may be used on more than one leg wherein a table extension may be placed over the table attachment to provide a longer table.

2 Claims, 12 Drawing Figures

TABLE ATTACHMENT

This application is a continuation-in-part of the earlier filed application for AN IMPROVED TABLE ATTACHMENT filed Jan. 15, 1979, Ser. No. 003,404.

FIELD OF THE INVENTION

This invention relates generally to furniture and, more particularly, to table attachments.

BACKGROUND OF THE INVENTION

In the past there have been many table attachments, Silverman, U.S. Pat. No. 1,962,575, for example. However, these attachments have needed tools and the like for attaching the attachment to the table leg. In addition, none of the table attachments in the past have provided a means for attaching the table to the table leg without the use of tools or the like. In addition, in the past no table attachment has provided a table attachment wherein the attachment may rotate a small distance about the leg.

In the past, no table attachment has been provided that could be attached to a hollow or solid leg as well as vertical and non-vertical table legs. Applicant has provided structure wherein no tools are necessary for attachment to the table leg and wherein the attachment may be moved laterally about the table leg a small distance to provide greater convenience to its user. The attachment while fixed vertically can be rotated a limited extent in all embodiments to provide greater convenience for its user. Moreover, utilizing the applicant's structure, the user may space multiple attachments a desired distance from the table top on the table leg to provide a means for extending the table.

OBJECTS OF THE INVENTION

An object of the invention is to provide a table attachment suitable for placing glasses and plates upon in a convenient manner while one is playing cards or the like.

Another object of this invention is to provide a table attachment which attaches to the table without the need of tools or the like in a quick, simple and efficient manner.

Another object of this invention is to provide a table attachment which is able to rotate laterally a limited distance to provide greater convenience to its user.

Another object of this invention is to provide a table attachment spaced a desired distance from the table top such that a table extension may be placed upon the table attachment extending the table a desired distance.

In accordance with these and other objects which will become apparent hereinafter, the instant invention will now be described with reference to the accompanying drawings in which:

DESCRIPTION OF THE DRAWINGS

FIG. 7 is another embodiment of the portable table attachment showing space for drinks and food and the like;

DESCRIPTION OF THE PREFERRED EMBODIMENT

Figure 1:
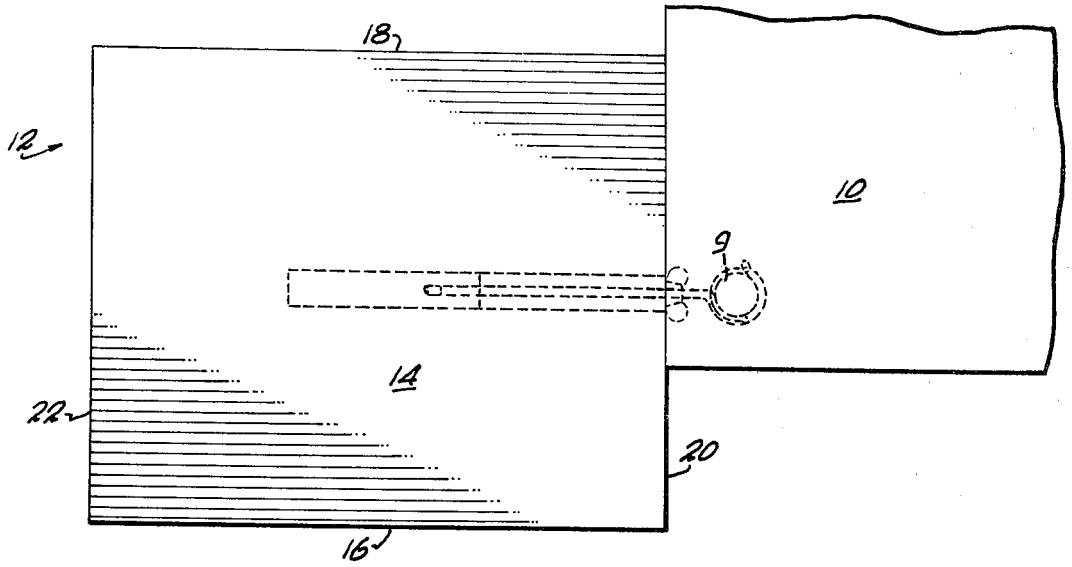
FIG. 1 is an elevational plan view of the portable table attachment.
Figure 2:
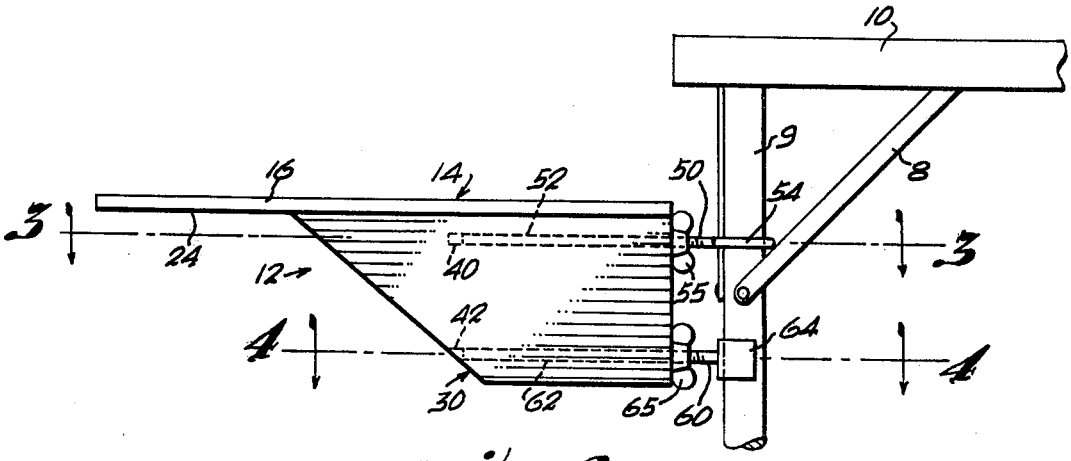
FIG. 2 is a side elevational view of the portable table attachment utilizing the hook engaging means.

Referring to the drawings wherein like reference characters designate like or corresponding parts throughout the several views and referring particularly to FIG. 1, there is shown the portable table attachment, generally designated by the numeral 12, attached to table 10. As can be seen in FIG. 2, the portable table attachment 12 is attached to the leg 9 of the table 10. The portable table attachment comprises a base 14. As seen in FIG. 1 the base 14 includes a first side edge 16 and a second side edge 18, a front edge 20 and a rear edge 22. The base can be made from suitable material including plexiglass, wood, or the like.

A support member, as seen in FIG. 2 and generally designated by the numeral 30 is connected to the underside of the base 24 approximately midway between the two side edges 16 and 18.

Figure 3:
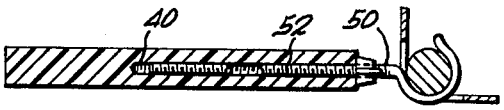
FIG. 3 is a top sectional view of the hook engaging means along line 3—3 of FIG. 2.
Figure 4:
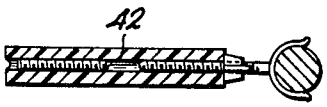
FIG. 4 is a sectional view of the support bracket along line 4—4 of FIG. 2.

With particular reference to FIG. 3 there is shown the support member 30 defining a top elongate hole 40. Elongate hole 40 may be threaded. With particular reference to FIG. 4 there is shown the support member 30, defining bottom elongate hole 42 which may extend through support member 30.

With particular reference to FIG. 2 there is shown one embodiment of the invention having an elongate engaging connector 50 and including a first end 52 threaded into top elongate threaded hole 40 and a second hook-like end 54 engaging the table leg 9 and supported by table support member 8. As shown in FIG. 3, the hook-like end 54 conforms to the size of leg 9 and matingly engages the leg. The connector is supported by table support member 8 to prevent downward vertical movement.

With particular reference to FIG. 2 there is shown an elongate supporting connector 60 having a first end 62 slidably engaging bottom elongate hole 42 and a second end 64 including support structure for engaging leg 9. As seen in FIG. 4 the second end 64 of the support connector 60 includes structure suitable for matingly engaging the table leg 9. The second end 64 while compatibly engaging the leg 9 allows the table support attachment to be rotated.

As seen in FIG. 2, wing nuts have been provided at 55 and 65 to allow the elongate ends 54 and 64 to be extended an adjustable but fixed distance from the support member 30.

As can be seen from FIG. 2 the portable table attachment can be rotated laterally an extent limited by the table support member 8 and the elongate connector member 50.

Figure 5:
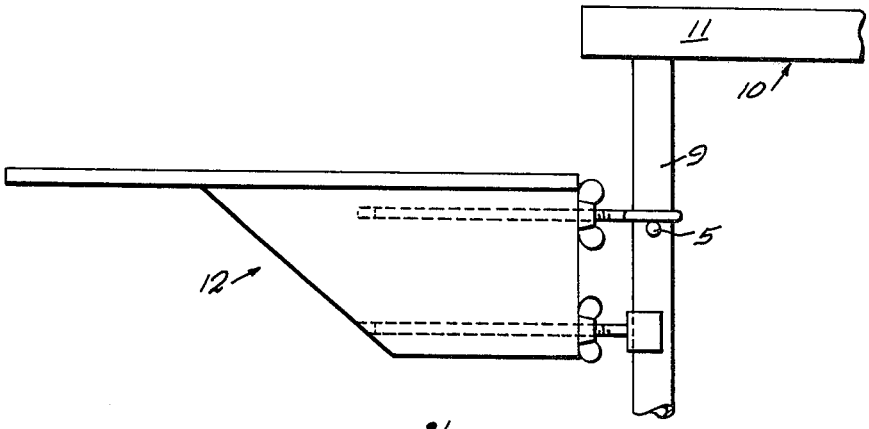
FIG. 5 is a side elevational view showing the portable table attachment supported by a support member fixedly attached to the leg of the table.

With particular reference to FIG. 5 there is shown the portable table attachment generally designated by the numeral 12 attached to table 10. Table 10 has no support member 8 as discussed previously. Instead, a leg support member 5 is fixedly attached to leg 9 and spaced the desired distance from the table top 11. In this way the portable table attachment can be suitably connected to the table and spaced the desired height from the table top.

Figure 6:
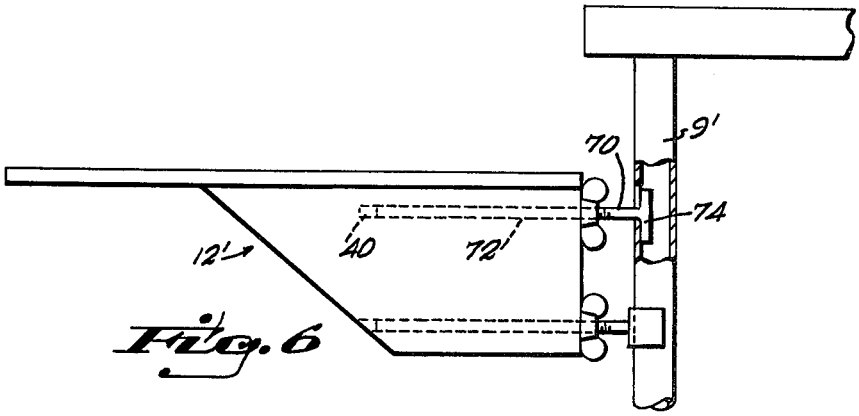
FIG. 6 is a side elevational view of another embodiment of the portable table attachment showing the attachment connected to the hollow leg of a table.

With particular reference to FIG. 6, there is shown another embodiment of the portable table attachment generally designated by the numeral 12′ attached to a hollow table leg 9′. A hole is drilled into leg 9′ and then enlarged laterally to allow for rotational movement of the portable table attachment. The portable table attachment is fitted with an elongate connector member 70 having a first end 72 threaded through top elongate hole 40 and a second bent end 74 fitted into the hole in table leg 9′ as seen in FIG. 6.

Figure 7:
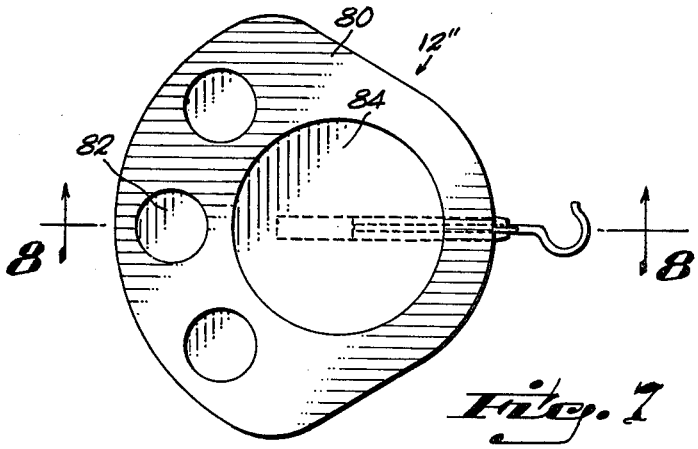

With particular reference to FIG. 7, there is shown another embodiment of the portable table attachment generally designated by the numeral 12″. In this embodiment, the base includes a top surface 80 having depressions 82 suitable for placing glasses and the like in those depressions such as will provide support to prevent the glasses from spilling. In addition, the portable table attachment 12′ is also provided with a large depression 84 in the surface 80 such as will provide suitable support for a plate or the like.

Figure 8:
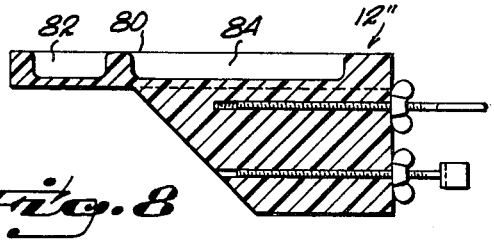
FIG. 8 is a sectional view of FIG. 7 taken along the lines as designated 8—8.

With particular reference to FIG. 8 there is shown the cross sectional view of the portable table attachment 12″. As can be seen from FIG. 8 the depressions 82 and 84 are of suitable depth so as to provide support for the items mentioned above such as they will prevent the items from readily spilling or tipping.

It will be noted by the person skilled in the art, although it is not shown, that multiple improved table attachments can be provided, such as those in FIG. 6, to allow a conventional table to be extended a desired distance. Utilizing two embodiments like those in FIG. 6, the user would merely space the hole drilled in the leg the desired distance from the table on two legs and then place a table extension upon the two table attachments to provide an extended table.

An alternative embodiment is shown in FIGS. 9 through 12. Applicant considers the embodiment shown therein to be the best mode for carrying out his invention.

Figure 9:
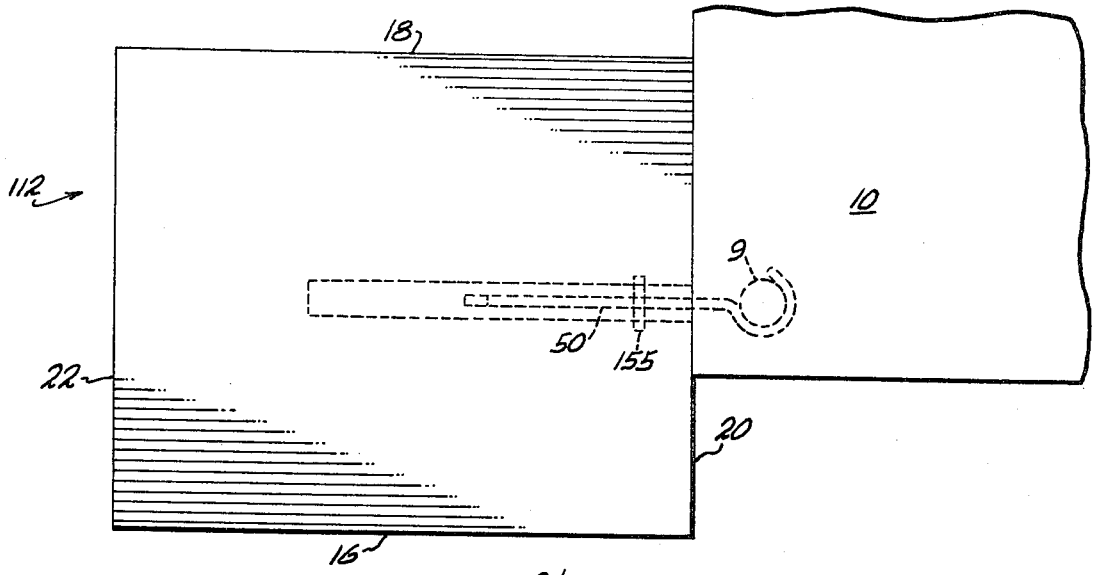
FIG. 9 is an elevational plan view of an alternative and preferred embodiment of the portable table attachment.

With respect to FIG. 9 there is shown the invention generally denoted 112. It will be noted that many of the same parts of the earlier embodiment are included in this embodiment. For example, the table attachment comprises a base 14, first and second side edges 16 and 18 respectively, and front and rear edges 20 and 22 respectively. Additionally, the same table attachment 10 with leg 9 may be used. The difference between the earlier embodiment and the present best mode embodiment comprises the means for adjusting the attachment. Eariler, it will be recalled that wing nuts 55 and 65 have been provided as an adjustment means. However, in this new embodiment, applicant uses knurled knob means 155 and 165 respectively. In order to use said means, the support member must have spaces adapted for connection with the knurled knob means and the spaces being approximately equal to but slightly greater than the length of the diameter of knurled knob means 155 and 165 respectively. Additionally, it will be noticed that there is no need now for the elongate holes 40 and 42 to be threaded.

Figure 10:
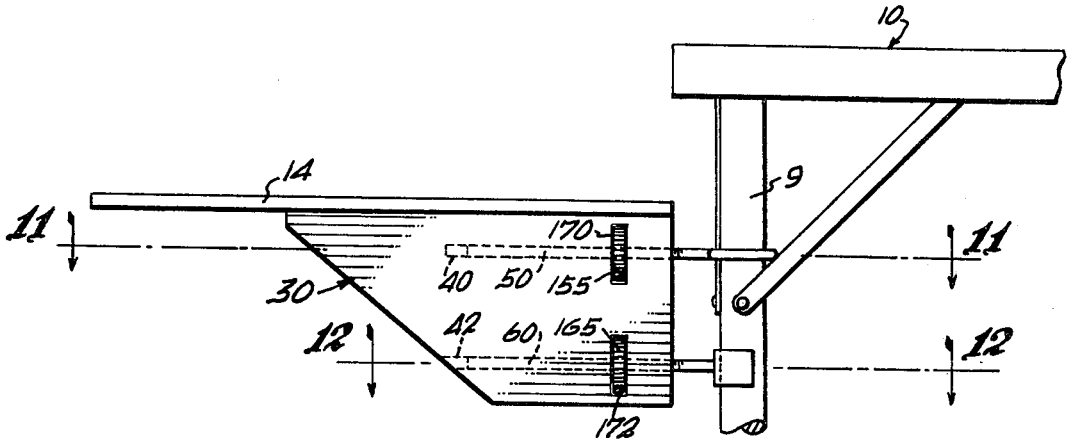
FIG. 10 is a side elevational view of the alternative preferred embodiment shown in FIG. 9.

While it is shown in FIG. 10 that the knurled knob means are aligned, it will be readily appreciated by one skilled in the art that alternative alignments are possible and are within the scope of this invention.

Figure 11:
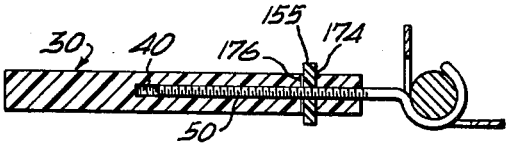
FIG. 11 is a top sectional view of the embodiment shown in FIG. 9 taken along line 11—11 of FIG. 10.

With particular reference to FIG. 3 there is shown the top elongate hole 40 which may be threaded as indicated in FIG. 11 but as explained previously, this is not necessary for the invention to work efficiently. As the knurled knob is rotated either counterclockwise or clockwise depending on the rotational sense of the thread of the elongate engaging connector 50, the connector will be moved to and fro so that an accurate means for adjustment is possible. This provides a great deal of convenience over the wing nut means which have been shown to be slightly cumbersome under heavy usage. It will be appreciated from FIG. 11 that the top void 170 is slightly larger than the knurled member 155 and that when member 155 is rotated to the proper desired position, the knurled member may be locked against the side of the void such as 174 or 176 depending upon the rotational sense of the knurled member and the elongate engaging connecting member 50.

Figure 12:
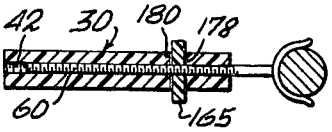
FIG. 12 is a top sectional view of the embodiment shown in FIG. 9 taken along line 12—12 of FIG. 10.

With particular reference to FIG. 12, there is shown the bottom connecting means wherein there is a knurled knob member 165 engaging elongate engaging member 60 in engaging in bottom elongate hole 42, which may be threaded as shown in FIG. 12. As previously mentioned, the support member 30 has been adapted in this embodiment to accommodate the knurled members 155 and 165 by having voids. The bottom void 172 also includes two sides, the first side being 178 and the second side being 180 thereby permitting the elongate engaging member 60 to be locked in place when the knurled knob member is abutting side wall 178 or 180 depending upon the rotational sense of the knob and the elongate engaging member 60.

While the instant invention is shown and described in what is considered to be a preferred embodiment, it is recognized that departures may be made within the scope of the claims which is set forth hereinafter and, accordingly, this invention is not to be limited except within the doctrine of equivalents under the law.

What is claimed is:

1. An improved table attachment for removably mounting on a table having legs, the attachment comprising:

a base having a top surface and a bottom surface and including two side edges with a centerline spaced equidistance from the side edges, a support member having an upper edge which is fixedly attached to the bottom surface of the base approximately across the centerline of the base, the support member includes a lower edge and front and rear sides, the support member defines a top elongate longitudinally threaded hole having an opening in the front side and a bottom longitudinal hole lower than the first and approximately parallel to the first having an opening in the front side and an opening in the rear side thereby the hole extends through the support member, means for connecting the portable table attachment to the table leg, the means engaging the top and bottom longitudinal hole and the table leg such that the attachment is able to pivot around the table leg a limited distance, the table including a longitudinal slit in the table leg spaced a desired distance from the table wherein the means for connecting the attachment to the table leg comprise:

a first elongate member having a first threaded end which engages the first hole and a second enlarged end which engages the slit in the table leg such that there is freedom for lateral movement of the elongate engaging member and such that the second enlarged end is captivated within the slit in the table leg, winged nut means threaded on the first end of the elongate engaging member and confronting the front side of the supporting member such that the second end of the elongate engaging member is extended a fixed, but adjustable distance from the front side, an elongate supporting member having a first threaded end sized for slidable engagement with the second hole in the support member and a second enlarged member sized for mating engagement with the table leg, and wing nut means threaded on the first end of the elongate supporting member confronting the front surface of the support member and fixing the distance of the second end of the elongate supporting member extends from the front side of the support member.

2. The device as set forth in claim 1 wherein the elongate supporting member has a length greater than the length of the support member from the front to rear side.

* * * * *